US006854474B1

(12) United States Patent
Chen

(10) Patent No.: US 6,854,474 B1
(45) Date of Patent: Feb. 15, 2005

(54) OPENABLE AND OBLIQUELY ROTATABLE UMBRELLA

(76) Inventor: Shiow-Hui Chen, 235 Chung-Ho, Box 8-24, Taipei (TW)

( * ) Notice: Subject to any disclaimer, the term of this patent is extended or adjusted under 35 U.S.C. 154(b) by 139 days.

(21) Appl. No.: 10/403,411

(22) Filed: Apr. 1, 2003

(51) Int. Cl.[7] ..... A45B 25/14

(52) U.S. Cl. ..... 135/20.3; 135/22; 135/24; 135/25.1

(58) Field of Search ..... 135/20.3, 22, 24, 135/25.1

(56) References Cited

U.S. PATENT DOCUMENTS 3,643,673 A * 2/1972 Weber ..... 135/25.1
4,878,509 A * 11/1989 Tung ..... 135/20.3
6,145,522 A * 11/2000 Ko ..... 135/24
6,360,759 B1 * 3/2002 Lin et al. ..... 135/24
2002/0153032 A1 * 10/2002 Lin et al.
2003/0000558 A1 * 1/2003 Chou
2004/0099298 A1 * 5/2004 Yen et al.

FOREIGN PATENT DOCUMENTS

JP 406169807 A * 6/1994

* cited by examiner

*Primary Examiner*—Anita King
*Assistant Examiner*—Jon Szumny

(57) ABSTRACT

An openable and obliquely rotatable umbrella comprises a rod body having an upper shaft and a lower shaft; an upper cell set firmly secured to the upper shaft; a lower cell set installed to the upper shaft and the lower shaft; two pulleys installed on the upper shaft; a rotatable tilting means installed between the upper shaft and the lower shaft; a spring installed at a lower end of the interior of the lower shaft; a pull line having a lower end connected to the spring; and an upper end thereof winding through the lower pulley and then being connected to the lower cell set; and a control switch installed to a distal end of an umbrella rib; and a button controlling two pull lines. By the movement of the button of the control switch, the orientations of the umbrella in expanding and folding operation are adjustable.

7 Claims, 16 Drawing Sheets

OPENABLE AND OBLIQUELY ROTATABLE UMBRELLA

FIELD OF THE INVENTION

The present invention relates to umbrellas, and particularly to an openable and obliquely rotatable umbrella, wherein by the movement of a button of a control switch in the umbrella, the orientations of the umbrella in expanding and folding operation are adjustable.

BACKGROUND OF THE INVENTION

In the prior art, a large-scale fixed type sun-shield umbrella has a central shaft which is fixed on a table surface or on ground. The central shaft may be a single-joint or multiple-joint product. There: is no rotation or tilting joint for adjusting the orientation of the umbrella. The expansion and folding of the umbrella are performed by rotating a manual stick, for example, that disclosed in U.S. Pat. No. 4,878,509, "Stepless Tilting Device For Umbrella".

The defect of above said prior art is that the tilting angle of the umbrella is performed by adjusting a middle shaft of the umbrella by using two hands to shake an adjusting arm. The horizontal angle is adjusted by rotating the middle shaft. The operation needs more power and thus is inconvenient.

Next, the operation of expanding or folding an umbrella by shaking the adjusting arm is slow and not flexible. When the umbrella is inserted in the center of a table surface, the operation of the umbrella will be affected by the table surface. The user must lean forwards for operating the shaking arm so that the operation is not easy.

SUMMARY OF THE INVENTION

Accordingly, the primary object of the present invention is to provide an openable and obliquely rotatable umbrella which comprises a rod body formed by an upper shaft and a lower shaft; an upper cell set firmly secured to a top of the upper shaft; a lower cell set slidably installed to the upper shaft and the lower shaft; two pulleys installed on the upper shaft; the two pulleys being an upper pulley and a lower pulley arranged in parallel; a rotatable tilting means installed between the upper shaft and the lower shaft; an umbrella surface installed on an surface expanded by a plurality of umbrella ribs fixing to the upper cell set; a spring installed at a lower end of the interior of the lower shaft; a pull line, a lower end of the pull line being connected to the spring; and an upper end thereof winding through the lower pulley and then being connected to the lower cell set; and a control switch installed to a distal end of an umbrella rib at an outer edge of the umbrella surface; a button being arranged within the control switch; the button controlling two pull lines; one of the pull line serving for pulling two first studs in the rotatable tilting means; and another pull line serving for pulling: a stop-proof block at a lower end of the upper shaft. By the movement of the button of the control switch, the orientations of the umbrella in expanding and folding are adjustable.

The various objects and advantages of the present invention will be more readily understood from the following detailed description when read in conjunction with the appended drawing.

BRIEF DESCRIPTION OF THE PREFERRED EMBODIMENTS

The present invention will be described hereinafter.

Figure 1:
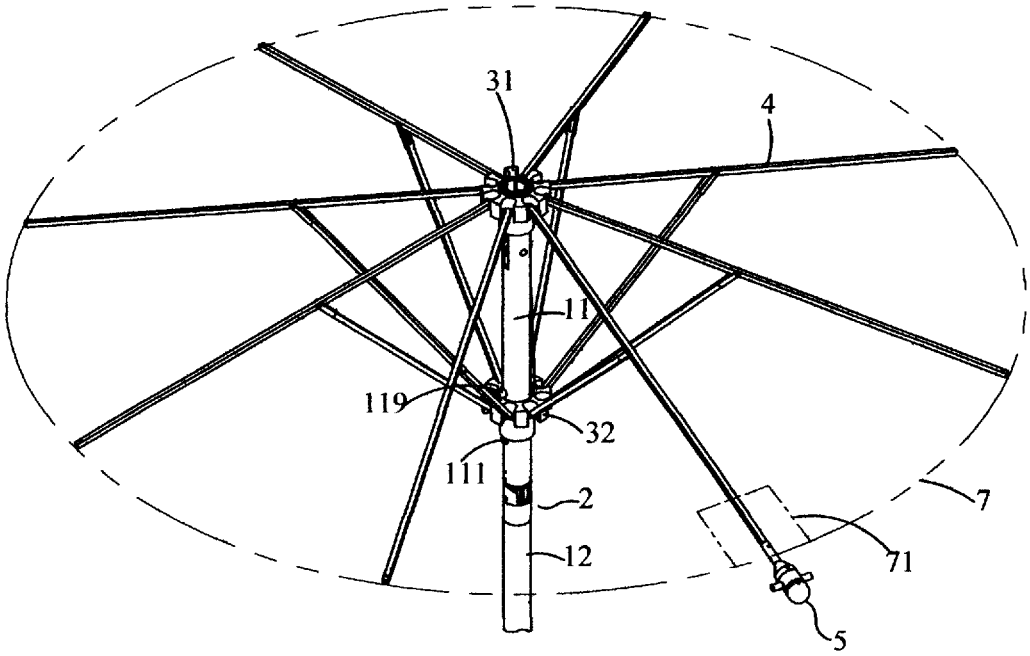
FIG. 1 is a perspective view showing that the umbrella of the present invention is expanded.
Figure 2:
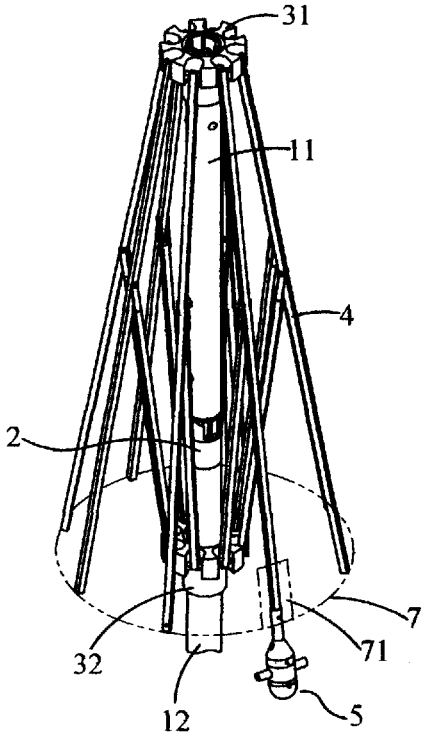
FIG. 2 is a perspective view showing the umbrella of the present invention is folded.

Referring to FIG. 1, the perspective view showing that an umbrella is expanded according to the present invention. The arrangement of the umbrella of the present invention is illustrated in FIG. 1. The umbrella of the present invention comprises an upper cell set 31, an upper shaft 11, a lower cell set 32, a rotatable tilting means 2 and a lower shaft 12. A control switch 5 is installed at a distal end of a rib 4 or at an outer edige of the enhancing sheet 71. FIG. 2 is a perspective view showing that the umbrella is folded.

Figure 3:
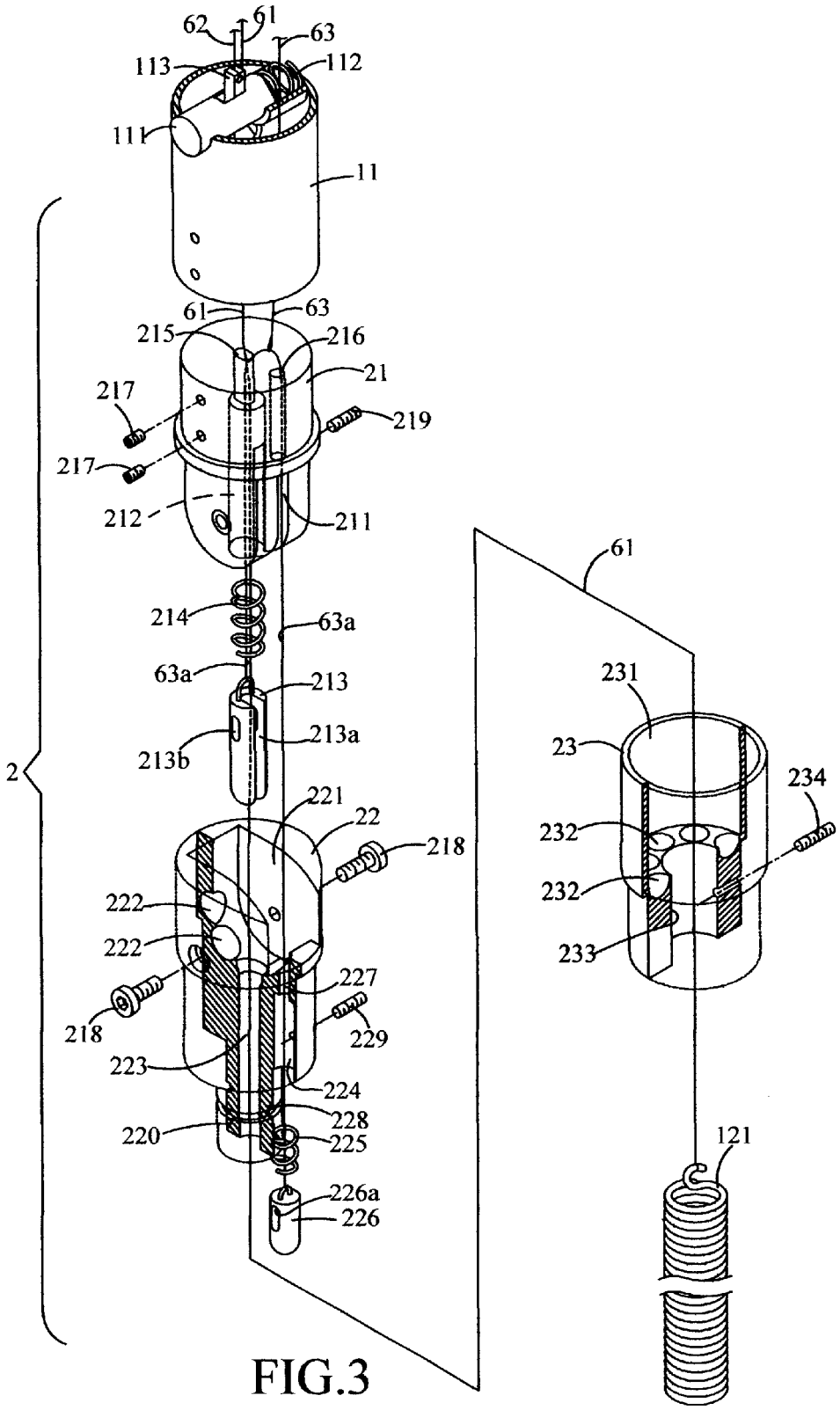
FIG. 3 is an exploded perspective view of the rotatable tilting means of the present invention.
Figure 4:
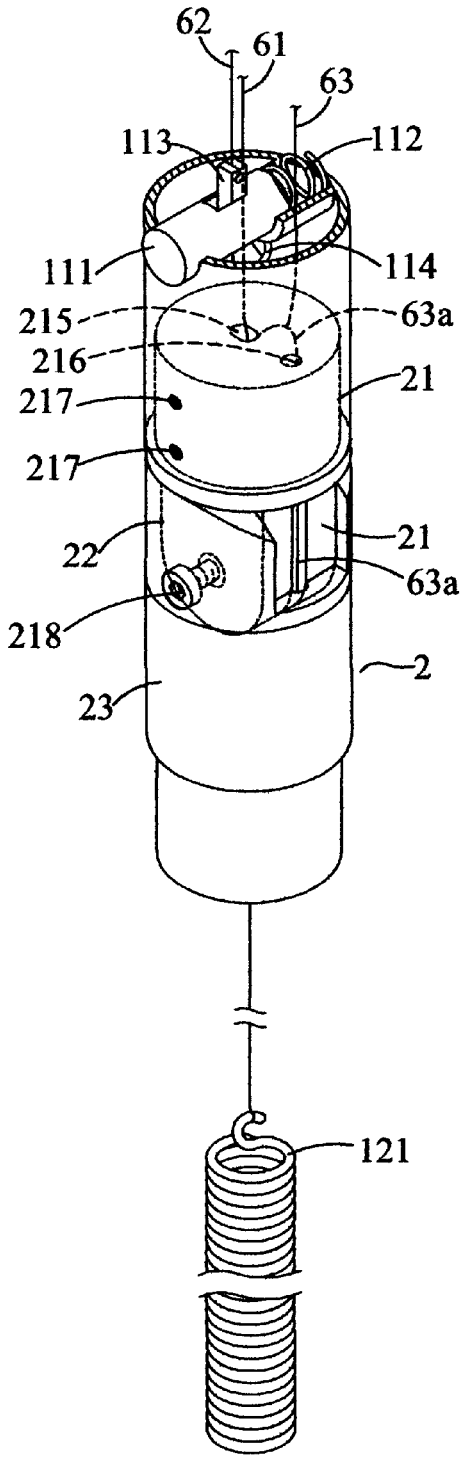
FIG. 4 is an assembled perspective view showing the rotatable tilting means of the present invention.

FIG. 3 is an exploded perspective view showing the rotatable tilting means 2 of the present invention. The rotatable tilting means 2 comprises a tilt platform 21, a rotary platform 22 and a rotary seat 23 which are arranged sequentially from the upper end to the lower end. FIG. 4 shows a perspective view of the assembled rotatable tilting means 2.

The tilt platform 21 can be divided into an upper half and a lower half. The upper half is placed within the upper shaft 11 and is locked by screws 217. The lower half has a semicircle shape, is placed in a receiving groove 221 of the rotatable tilting means 2 and is locked by a screw 218. The lower half serves to adjust orientation unidirectionally in the receiving groove 221. The lower half of the tilt platform 21 is further installed with a stud groove 212 which has a though hole 215.

Figure 11:
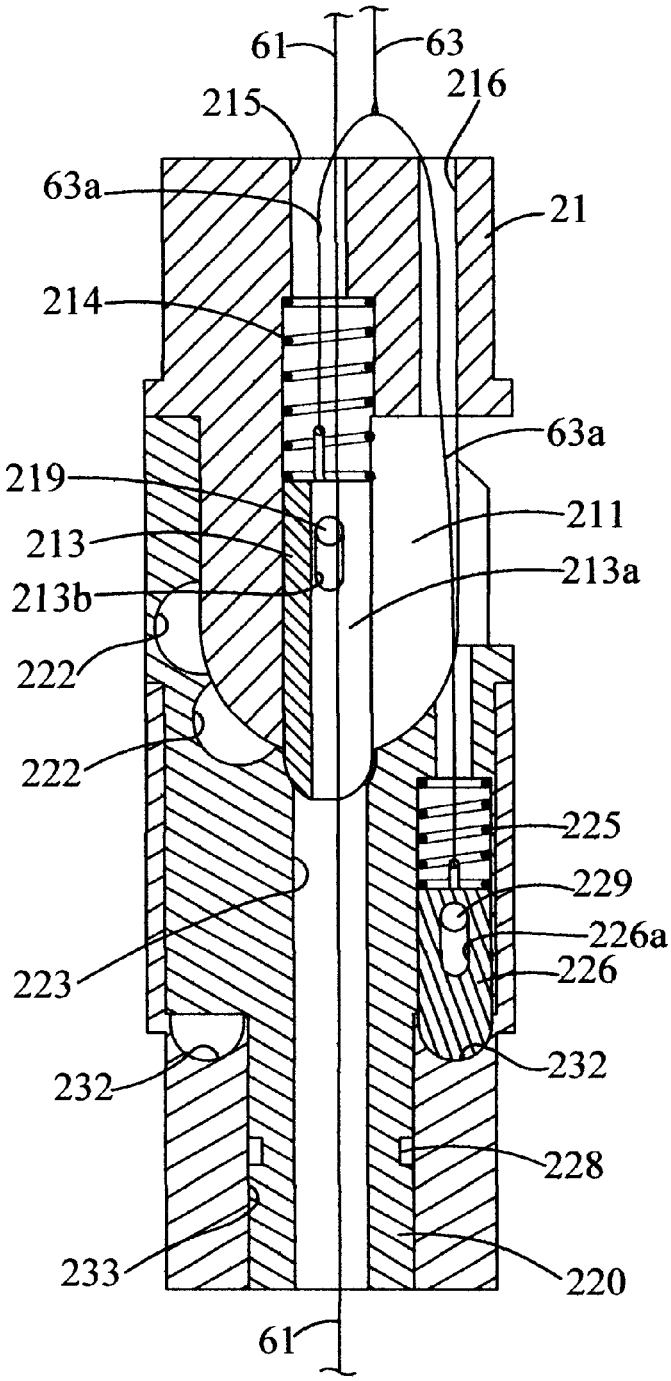
FIG. 11 is a cross section view showing the positioning of the rotatable tilting means of the present invention.

A stud 213 and a spring 214 are placed in the stud groove 212. A top of the stud 213 is connected to a stud pull line 63*a*. The stud pull line 63*a* protrudes out of the through hole 215. A screw 219 inserts into a long hole 213*b* so as to lock the stud 213 to the stud groove 212. The detail of this structure will be described in the following with reference to FIG. 11.

Besides, a lower end of the rotary platform 22 is installed with a stud groove 224. A stud 226 and a spring 225 are installed in the stud groove 224. A top of the stud 226 is connected to the stud pull line 63*a* (the pull line of the stud 213 is identical to the pull line of the stud 226, that is, stud pull line 63*a*). The stud pull line 63*a* passes through the through hole 227 at a top of the stud groove 224 and then passes through the guide groove 211 of the tilt platform 21, and then passes through a top 216 of a through hole. By pulling the stud pull line 63*a*, the studs 213, 226 can move at, the same time. Besides, a screw 229 passes through the long hole 226*a* of the stud 226 in the stud groove 224 so that the stud 226 will not separate from the stud groove 224. The details will be understood from the description about FIG. 11 of the present invention.

The lower half of the rotary platform 22 is inserted into the receiving groove 231 of the rotary seat 23 so that the two are combined. A post 220 at the lowermost end of the rotary platform 22 is formed with an annular trench 228. When the post 220 is combined to the hollow groove of the rotary seat 23, a screw 234 is deeply locked into the annular trench 228 so that the rotary platform 22 can rotate horizontailly in the rotary seat 23 without separation therefrom.

Figure 7:
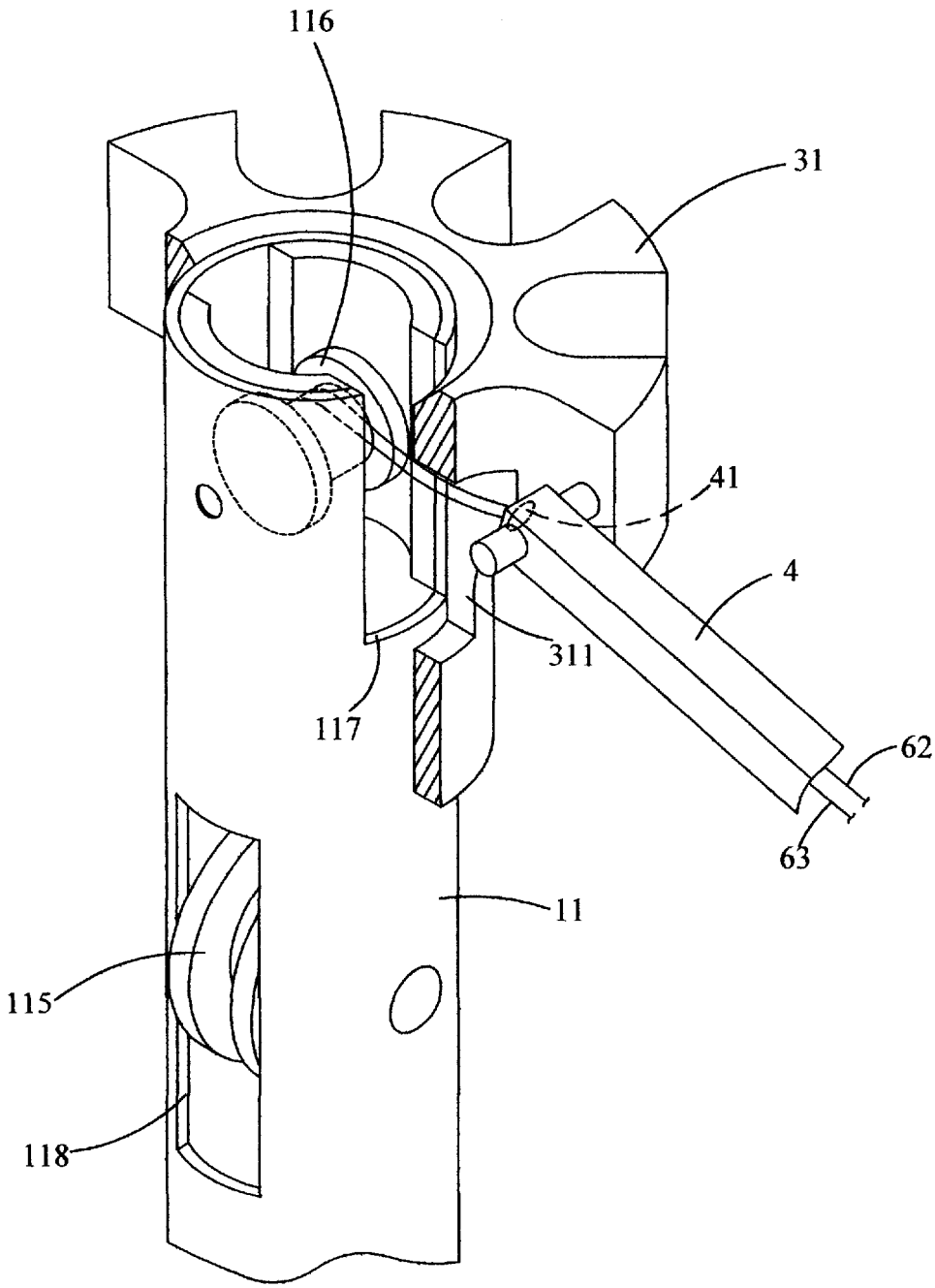
FIG. 7 is a cross section view showing the upper cell set of the present invention.
Figure 8:
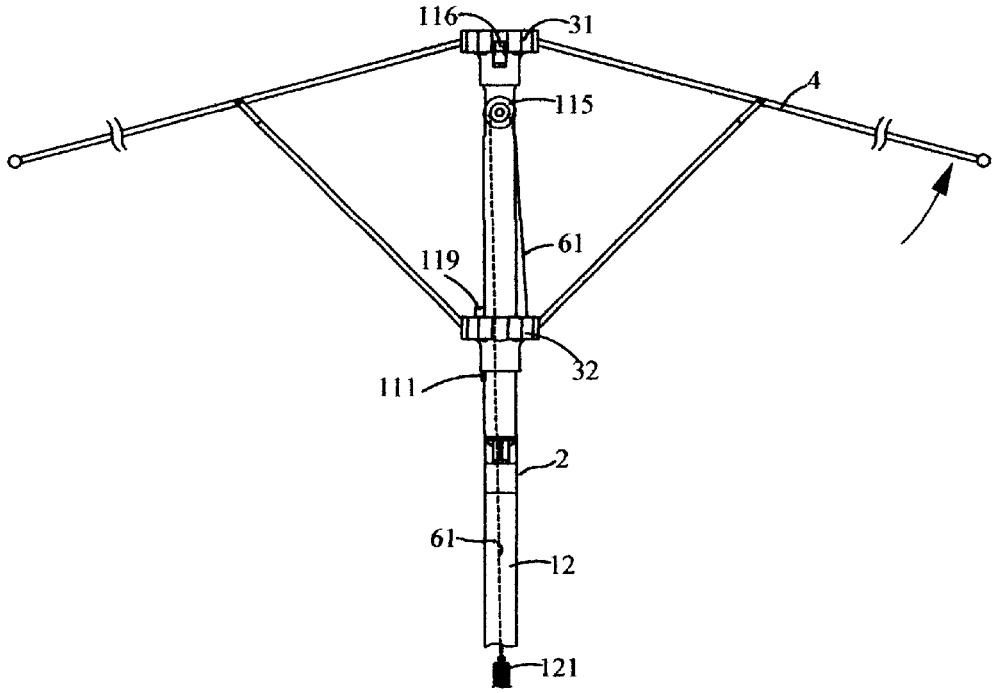
FIG. 8 is a schematic view showing that the umbrella of the present invention is expanded.
Figure 9:
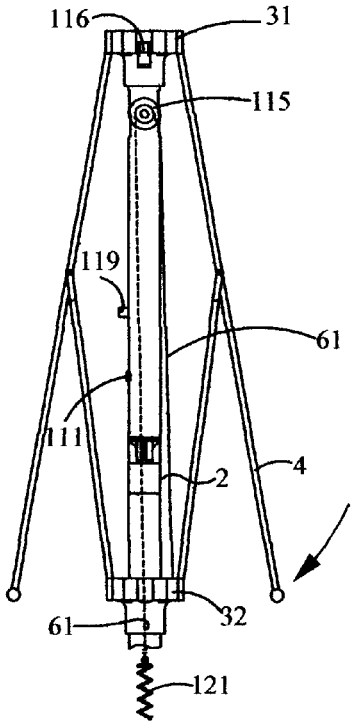
FIG. 9 is a schematic view showing that the umbrella of the present invention is folded.

Referring to FIGS. 8 and 9, and FIG. 3, the principle for power-saving operation of the umbrella of the present invention will be described herein. In the present invention, the elastic force of the spring 121 is balanced with the weight of the ribs 4, a lower cell set 32 and the umbrella cloth. The spring 121 is fixed to a lower end internal to the lower shaft 12. An upper end of the spring 121 is connected to a wire 61. The wire 61 passes through the through hole 223 of the rotary platform 22, the guide groove 213*a* of the stud 213 (when the tilt platform 21 is inclined, the guide groove 213*a* can prevent the stud 213 from pressing against the wire 61), the spring 214, a receiving groove 212, and the through hole 215 sequentially. Finally, the wire 61 winds through and out of a lower pulley 115 to be connected to the lower cell set 32. In the present invention, two pulleys are installed at a top end of the upper shaft 11, they are an upper pulley 116 and a lower pulley 1.15 which are vertical to one another. They are clearly shown in FIG. 7.

Figure 16:
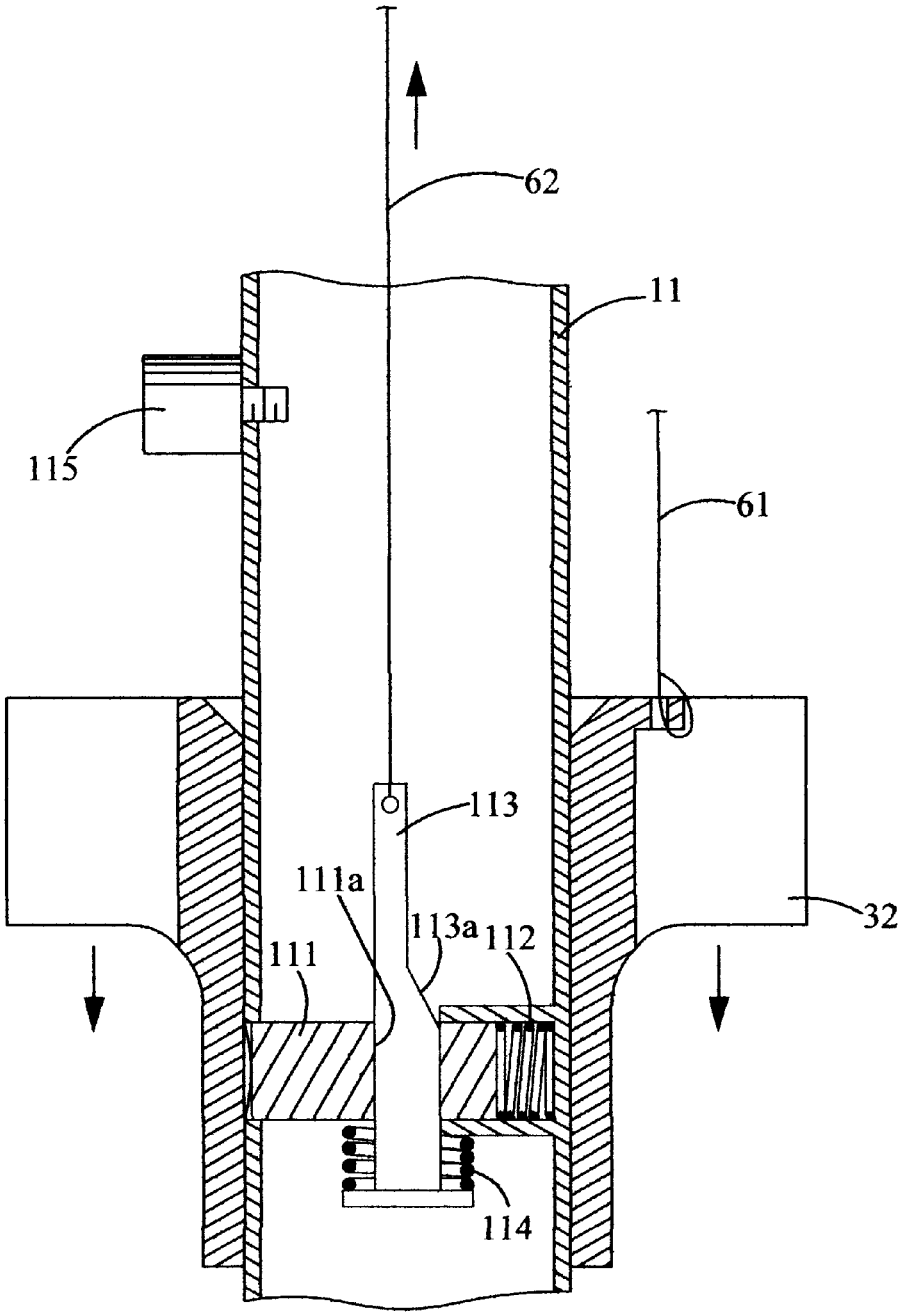
FIG. 16 is a schematic view showing that the stop-proof block of the present invention is reduced inwards.

When the umbrella is expanded, the spring 121 is folded. The elastic force is sufficient to pull the lower cell set 32 by the wire 61. When the umbrella is expanded, the lower cell set 32 is exactly positioned between a stopper 119 of the upper shaft 11 and a slide-proof block 111 (referring to FIG. 8). When the umbrella is folded, the operator only needs to press a distal end of the rib 4 by one finger (referring to FIG. 9) to a predetermined angle (since the torque is too large thereby the operation is easily performed) so as to force the lower cell set 32 to descend. The wire 61 will extend the spring 121. Since at this time, the resilient force of the spring 121 is not sufficient to pull the lower cell set 32 upwards. Thereby, the umbrella is folded. The reason that the lower cell set 32 descends will be understood at the description of FIG. 16.

Figure 6:
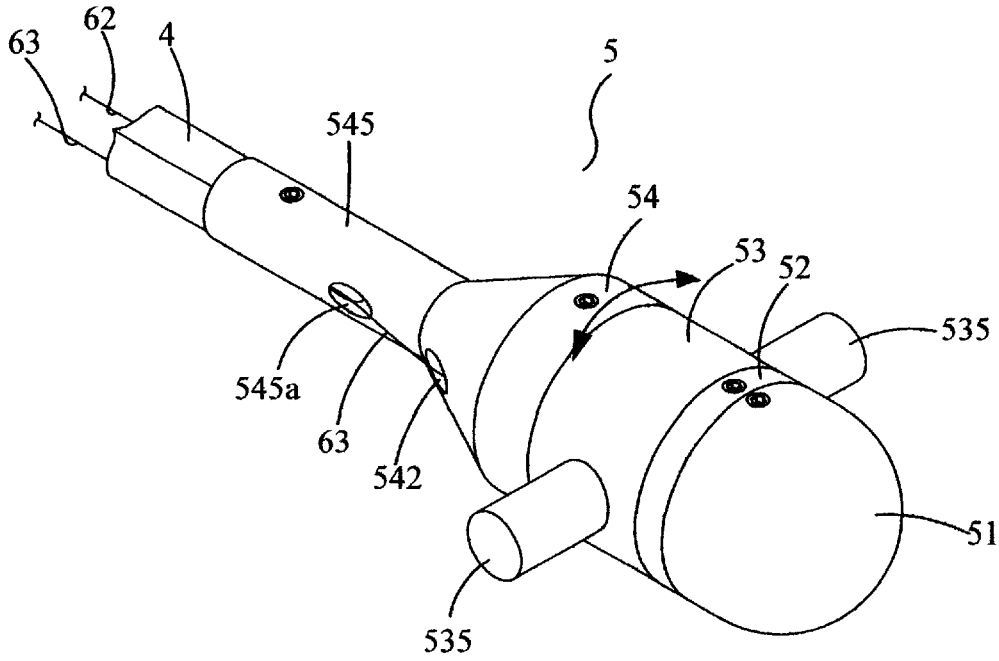
FIG. 6 is an assembled perspective view of the control switch of the present invention.

Referring to FIG. 6, the exploded perspective view about the control switch 5 of the present invention will be described herein. The control switch 5 is formed by an outer cover 51, an upper cover 52, a button 53, a spring 55, a base 54 sequentially. The perspective view of the control switch 5 is illustrated in FIG. 6. t One end of the base 54 is a tube 545. The tube 545 is connected to a distal end of one rib 4 by for example screws 553, 554, or the tube 545 is tied to the enhancing sheet 71 of the umbrella surface 7 (referring to FIG. 7).

There are two pull lines extending from a rib hole 41. One is the stud pull line 63*a* (has been described above), and another one is a slide-proof pull line 62 (will be described hereinafter). The two pull wires 62 and 63 wind through the upper pulley 116 (referring to FIG. 7) and then pass through a notch 117 and a notch 311 of the upper cell set 31 and then enter into the rib hole 41. Then the two wires pass out of the through holes 545*a* and 545*b* at two sides of the tube 545 and then pass through the through holes 522 and 523 of the upper cover 52 so that the two lines 62 and 63 will not separate from the control switch 5.

Besides, the button 53 is installed between the upper cover 52 and the base 54. A middle shaft 546 of the base 54 penetrates through the button 53 and the upper cover 52 and then enters into the interior of the outer cover 51. Two screws 551 and 552 lock into the upper cover 52 and the outer cover 51 to fix the middle shaft 546. Thereby, only the button 51 can rotate clockwise or counterclockwise. Other components can not rotate.

A protruding piece 531 is installed within the button 53. A spring 55 passes through a through hole 534 of the protruding piece 531. Two ends of the spring 55 are fixed to the recess hole 544 of the base 54 and the through hole 524 of the upper cover 52. When the spring 55 is not twisted, the recess 544, and through holes 534 and 524 are linearly arranged. At this time, the control switch 5 is not operated (Referring to FIG. 10). The two studs 213 and 226 of the rotatable tilting means 2 (referring to FIG. 11) are placed in the positioning holes 222 and 232. Thereby, at this time, the umbrella can not be adjusted horizontally or obliquely. The positioning holes 222 and 232 are semicircles. The positioning holes 222 are formed at a bottom of the receiving groove 221 and are positioned linearly, in FIG. 3 three positioning holes 222 are illustrated, one of the positioning hole is located above the through hole 223. There are a plurality of positioning holes 232 which are annularly arranged at a bottom of the receiving groove 231 of the rotary seat 23, as shown in FIG. 1.

Figure 5:
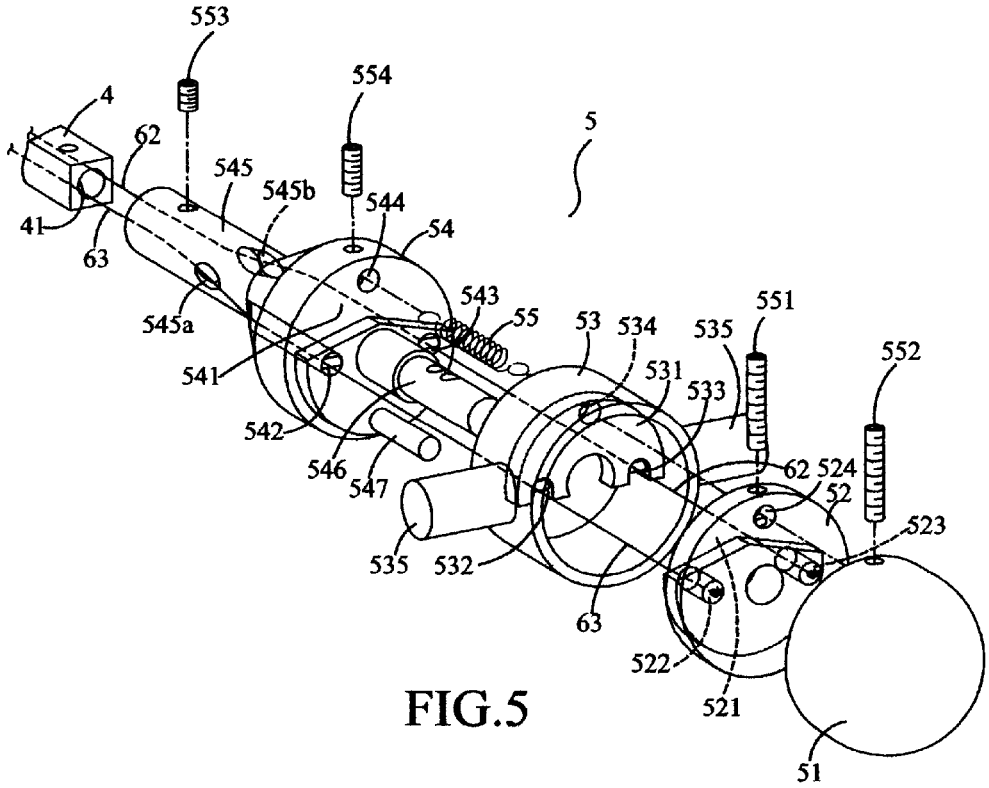
FIG. 5 is an exploded perspective view of the control switch of the present invention.
Figure 10:
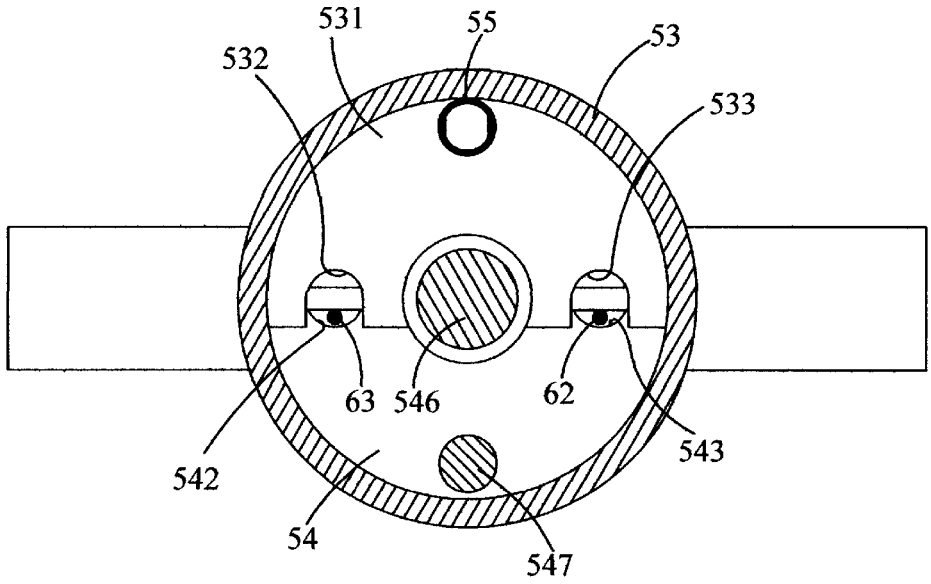
FIG. 10 is a cross section view showing that the control switch of the present invention does not rotate.
Figure 13:
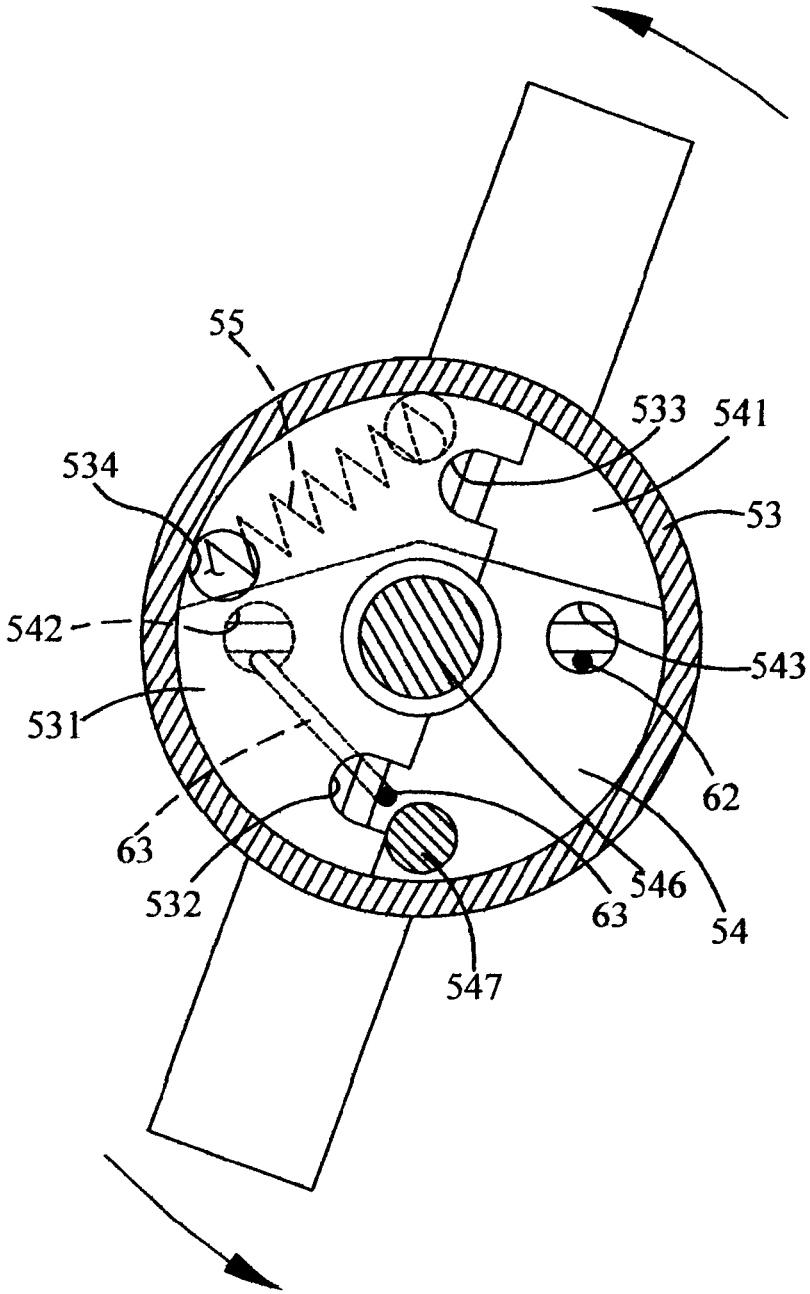
FIG. 13 is a schematic view showing that that the stud pull line is pulled by the control switch according to the present invention.
Figure 14:
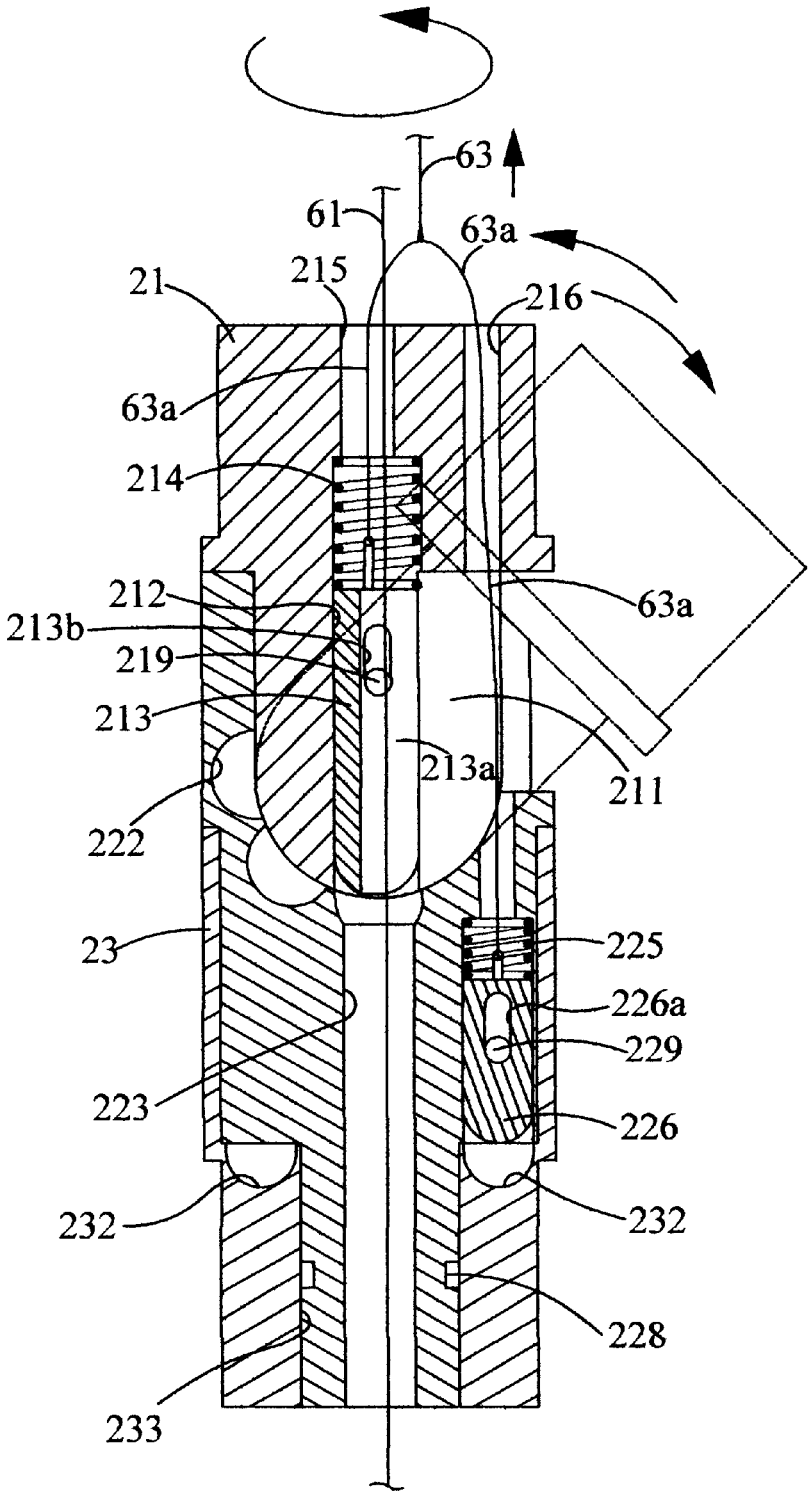
FIG. 14 is a cross section view showing that the rotatable tilting means is released according to the present invention.

Referring to FIGS. 5 and 13, when the protruded movable rod 535: of the button 53 rotates counterclockwise due to action of a finger, it will turn until the semicircle protruding piece 531 is stopped by the post 547 on the base 54. At this time, the rotating angle of the notch 532 of the protruding piece 531 is sufficient to pull the pull line 63 through a length. The length is sufficient for the two stud pull lines 63*a* to pull the studs 213 and 226 upwards so as to separate from the positioning holes 222, 232. At this time, the inclined angle and horizontal angle of the umbrella are adjustable. In adjusting the inclined angle, it is only necessary to pull upwards or press downward the control switch 5. In adjusting the horizontal rotating angle, it is only necessary to swing the control switch 5 leftward and rightward. The operation is easy. Meanwhile, the spring 55 has been pulled and the extending portion of the spring is exactly positioned in the sector notches 541 and 521 between the button 53 of the base 54 and between the upper cover 52 and the button 53, respectively. Thereby, the movement of the spring 55, is not hindered due to the rotation of the button 53. After adjustment, the applied force is released. The button 53 will restore to a middle position as shown in FIG. 10 due to compression of the spring 55. The two studs 213 and 226 insert into the respective positioning holes 222, 232 by the resilient force of the springs 214 and 225.

Figure 12:
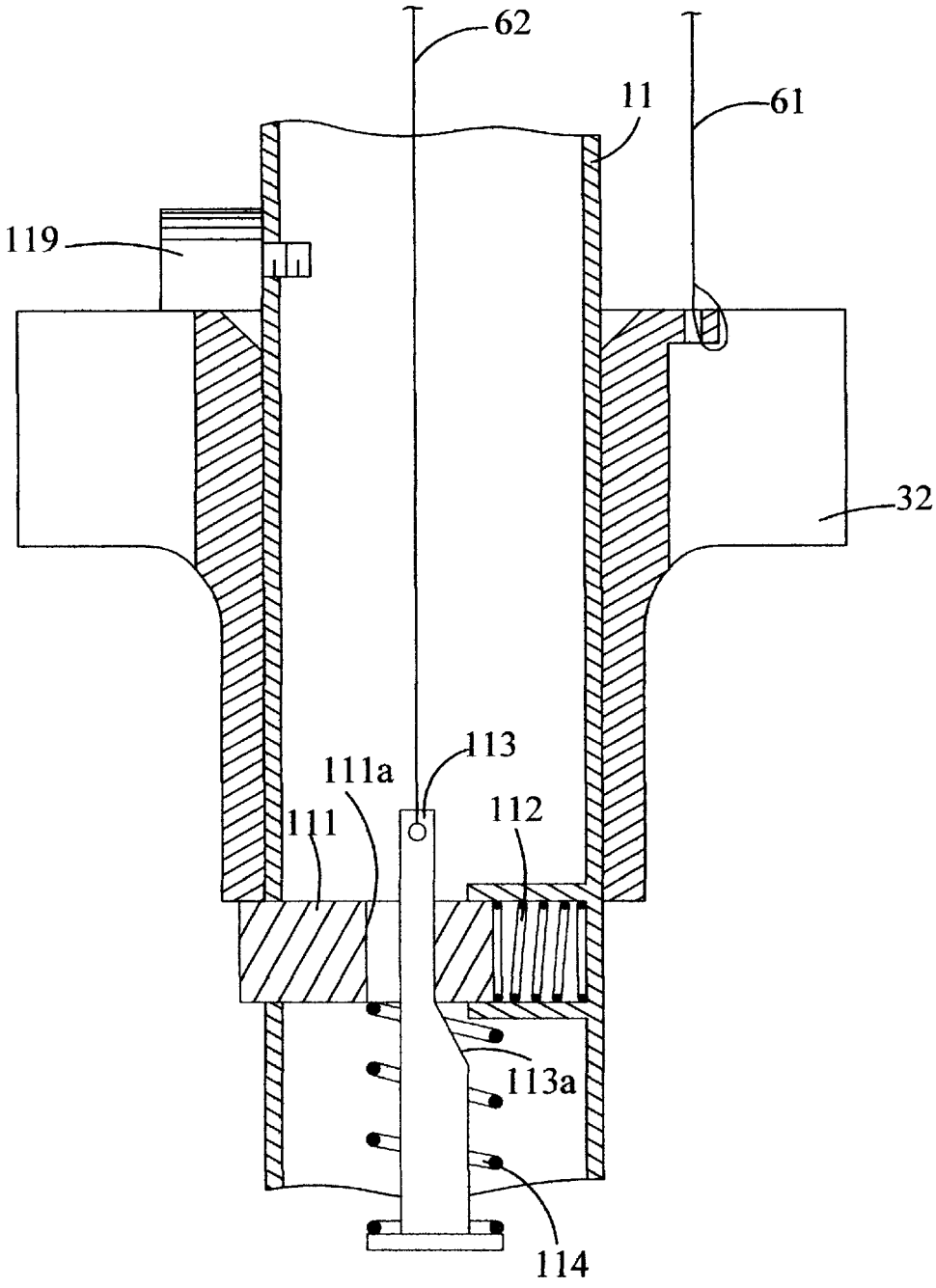
FIG. 12 is a schematic view showing the positioning operation of the stop-proof block of the present invention.

FIG. 12 is a schematic view showing the positioning operation of the slide-proof block of the present invention which prevents the lower cell set 32 from sliding downwardly due to the umbrella being pressed downward improperly. The stop-proof block 111 is installed at a predetermined position of the upper shaft 11, referring to the perspective view of FIG. 1. The stop-proof block 111 is supported by the spring 112 so as to protrude out of the rod body 11 normally so that the lower end of the lower cell set 32 is hindered from sliding downwards.

Figure 15:
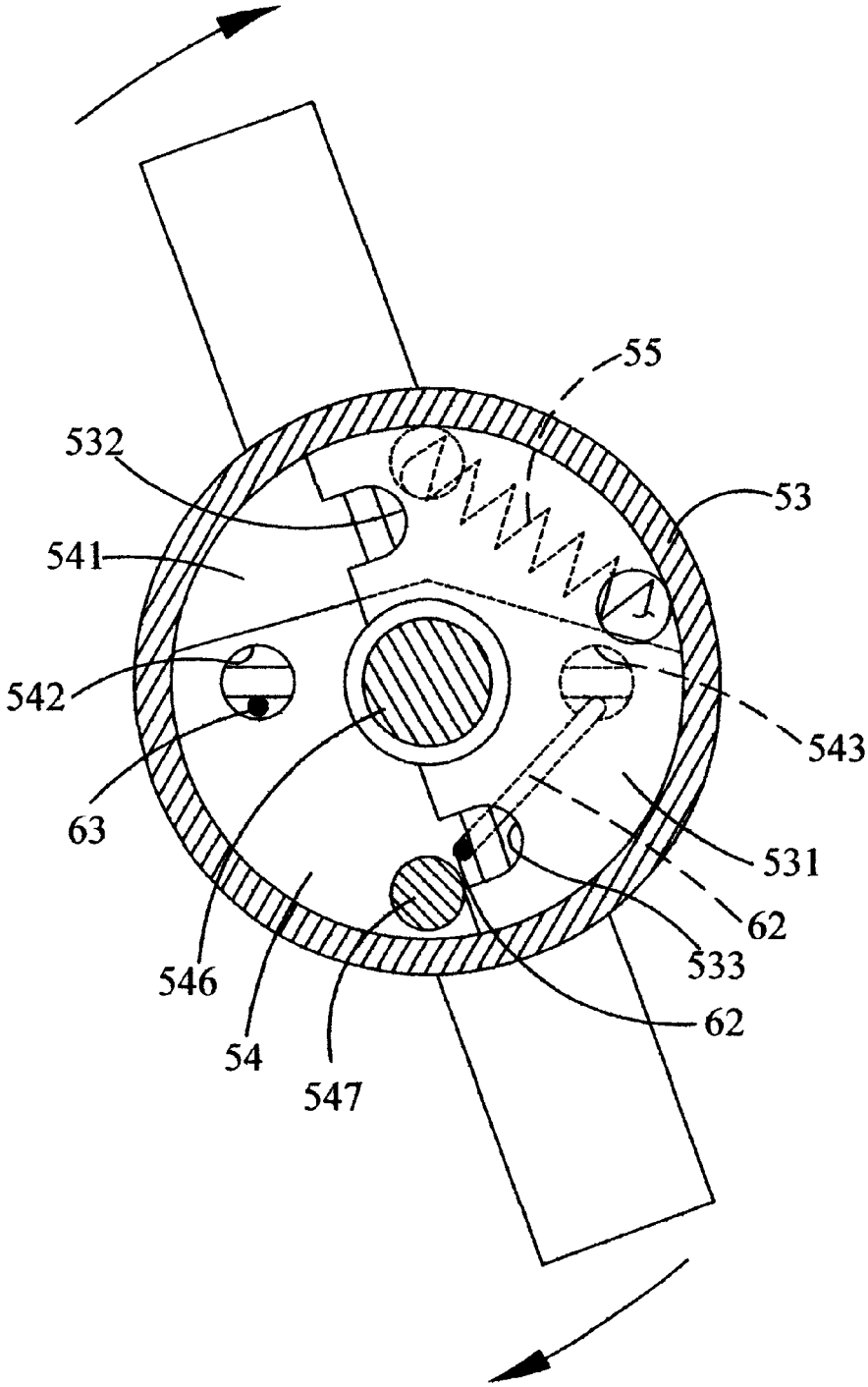
FIG. 15 is a schematic view showing that the pull wire of the stop-pro'of block is pulled by the control switch according to the present invention.

When the umbrella is folded, it is only necessary to move the rod 535 of the button 53 by a finger so that it can rotate clockwise (referring to FIG. 15). The wire 62 of the stop-proof block will pull the pull strip 113 upwards (like the operation of the stud pull line 63). When the inclined surface 113*a* of the pull strip 113 rises to enter into the recess 111*a* of the stop-proof block 111, the stop-proof block 111 will reduce into the rod body 11 (referring to FIG. 16) without exposing out. Thereby, the lower cell set 32 will not be hindered by the stop-proof block 111. At this time, when the control switch 5 is pressed downward and by the weight of the umbrella surface 7 and the pressing of the lower cell set 32, the lower cell set 32 can slide downward and thus the umbrella is folded. When the applied force is released, the pull strip 113 descends by the resilience of the spring 114, and the stop-proof block 111 is restored to the original state due to the resilient action of the spring 112 and protruded out of the rod body 11.

Figure 17:
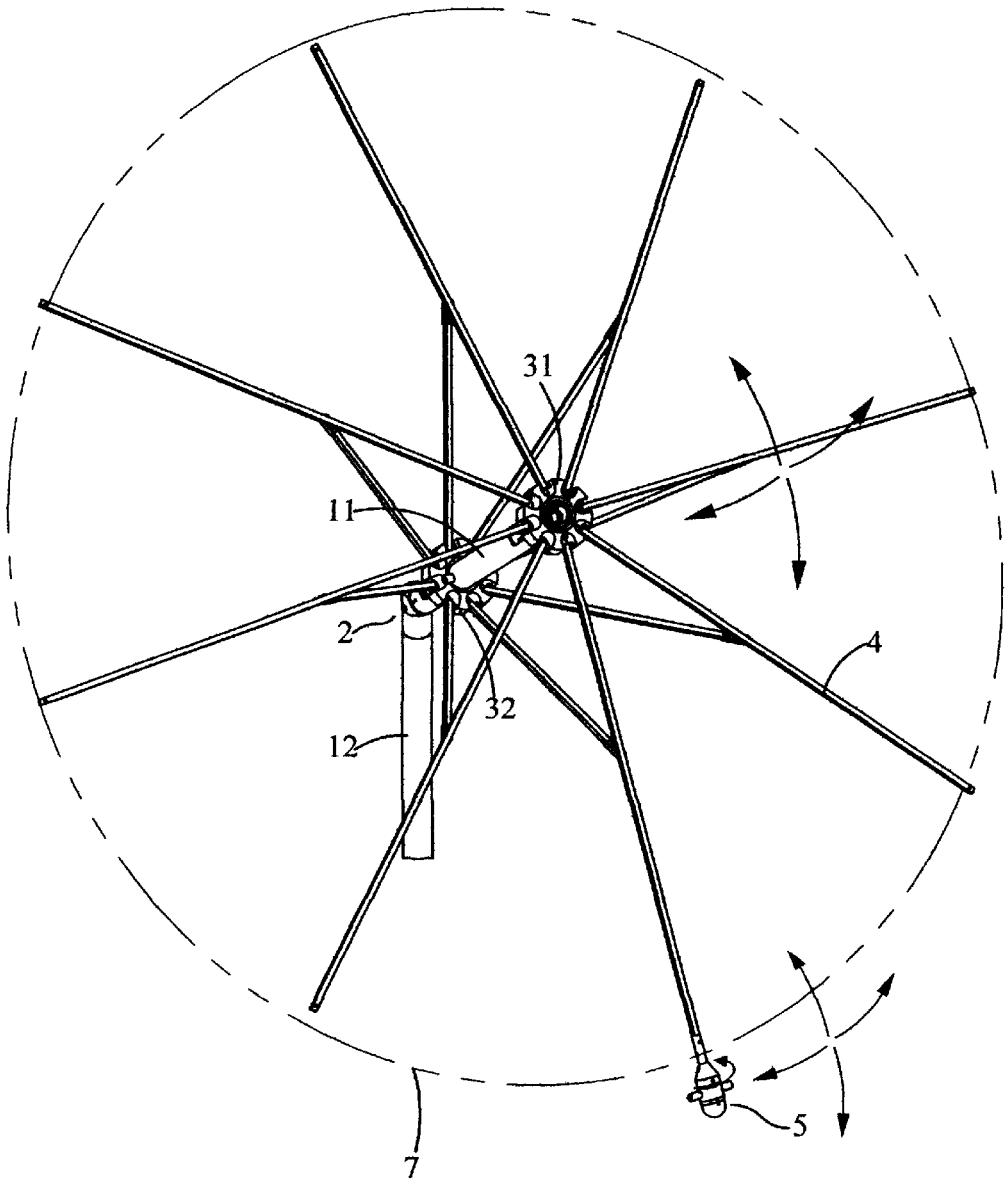
FIG. 17 is a schematic view showing the use of the present invention, wherein the umbrella surface is inclined.

A schematic view of the present invention is illustrated in FIG. 17. When the user can operates the control switch 5 by only one hand, and cause the button 53 to rotate counterclockwise and then move the control switch 5 upwards and downward to adjust the tilt angle of the umbrella surface 7, or to move the control switch 5 leftward and rightward so as to change the horizontal rotating angle of the umbrella surface 7. The operation is convenient.

Figure 18:
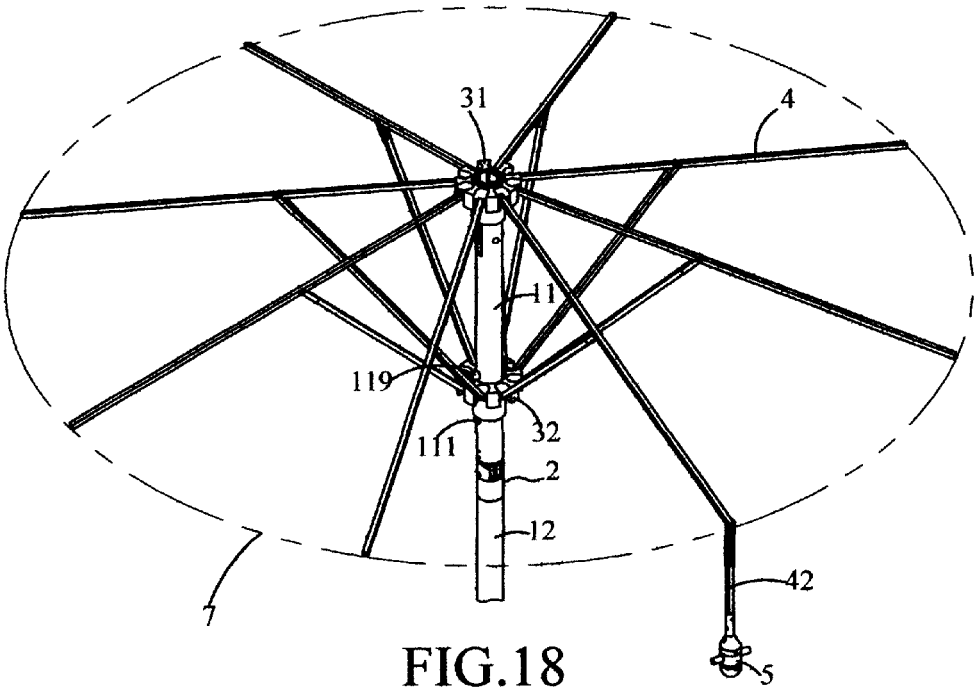
FIG. 18 is a perspective view of another embodiment of the present invention, where the umbrella is expanded.
Figure 19:
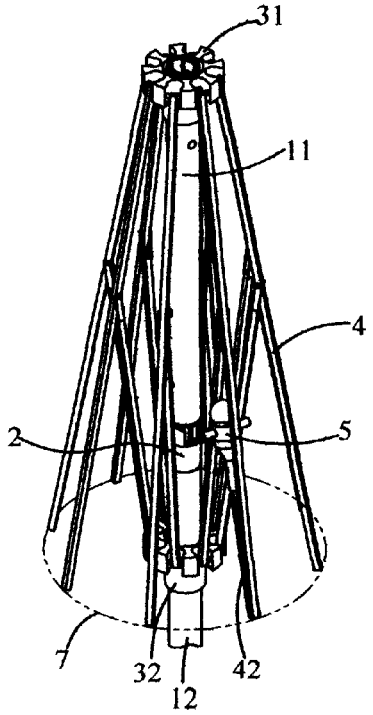
FIG. 19 is a perspective view of another embodiment of the present invention, where the umbrella is folded.

FIGS. 18 and 19 are perspective views showing that the present invention is used in the operation of expanding or folding the umbrella. A distal end of the rib 5 is added with a rotatable extending rod 42 and the control switch 5 is connected to a distal end of the extending rod 42. Therefore, the user can operate the umbrella without lifting his (or her) hand higher. Moreover, the short people can touch it easily. When the umbrella is folded, the control switch 5 can be placed in the umbrella surface 7, as shown in FIG. 19.

The effect of the present invention is that the expanding and folding operation of the umbrella can be performed easily; the tilt angle and horizontal rotating angle can be adjusted conveniently; when the umbrella is inserted at a center of a table, the user's operation will not effect by the table surface. The operation of the present invention can be performed easily and rapidly.

What is claimed is:

1. An openable and obliquely rotatable umbrella comprising:

a rod body comprising an upper shaft and a lower shaft;

an upper cell set firmly secured to a top of the upper shaft;

a lower cell set slidably installed to the upper shaft and the lower shaft;

two pulleys installed on the upper shaft; the two pulleys being an upper pulley and a lower pulley arranged in parallel;

a rotatable tilting means installed between the upper shaft and the lower shaft;

an umbrella surface installed on an surface expanded by a plurality of umbrella ribs fixing to the upper cell set;

a spring installed at a lower end of an interior of the lower shaft;

a pull line, a lower end of the pull line being connected to the spring; and an upper end thereof winding through the lower pulley and then being connected to the lower cell set; and a control switch installed to a distal end of an umbrella rib at an outer edge of the umbrella surface; a button being arranged within the control switch; the button controlling two pull lines; one of the pull lines serving for pulling two first studs in the rotatable tilting means; and another pull line serving for pulling a stop-proof block at a lower end of the upper shaft;

whereby by the movement of the button of the control switch, the orientations of the umbrella in expanding and folding operation are adjustable.

2. The umbrella as claimed as claim 1, wherein the rotatable tilting means comprises a tilt platform, a rotary platform, and a rotary seat; the tilt platform is movably installed to the rotary seat; a second stud is positioned in a positioning hole of the rotary seat; the two first studs are controlled by the same pull line so as to separate from the positioning hole for adjusting the tilt angle and horizontal rotating angle of the umbrella.

3. The umbrella as claimed as claim 2, wherein a plurality of positioning holes of the rotary platform are linearly arranged at a bottom of a receiving groove of the rotatable tilting means; one positioning hole is formed at an upper end of a through hole; a plurality of positioning holes of the rotary seat are at a bottom of the receiving groove and are annularly arranged.

4. The umbrella as claimed as claim 2, wherein the two first studs are installed in a receiving groove of the tilt platform and a receiving groove of the rotary seat, respectively; two screws insert into long holes of the two first studs so as to lock the two studs; an upper end of each first stud resisting against the spring.

5. The umbrella as claimed as claim 1, whereby the stop-proof block at the lower end of the upper shaft resists against a second spring so as to expose out from the rod body for hindering the lower cell set; a pull strip passes through the stop-proof block and the pull strip further resists against a third spring; an upper end of the pull strip is connected to the pull lines which extends to the control switch.

6. The umbrella as claimed as claim 1, wherein the control switch is formed by an outer cover, an upper cover, a button, a spring, a base sequentially; one end of the base is a tube; the tube is connected to a distal end of one rib; the two first pull wires wind through the upper pulley and then pass through a rod notch and a notch of the upper cell set and then enter into a rib hole; then the two wires pass out of the through holes at two sides of the tube and then pass through the through holes of the upper cover so that the two lines will not separate from the control switch; the button is installed between the upper cover and the base; a middle shaft of the base penetrates through the button and the upper cover and then enters into the interior of the outer cover; a protruding piece is installed within the button; a third spring passes through a through hole of the protruding piece; one end of the spring is fixed to a recess hole of the base and the through hole of the upper cover.

7. The umbrella as claimed as claim 6, wherein sector notches are formed between the button and the base and between the upper cover and the button respectively; the button is installed with a semicircle protruding piece; a post of the base inserts into the button for hindering the semicircle protruding piece.

* * * * *